US005190253A

United States Patent [19]

Sable

[11] Patent Number: 5,190,253

[45] Date of Patent: Mar. 2, 1993

[54] COLLAPSIBLE HOLDER FOR THERMOPLASTIC BAGS

[75] Inventor: Lewis E. Sable, Rochester, N.Y.

[73] Assignee: Mobil Oil Corporation, Fairfax, Va.

[21] Appl. No.: 827,313

[22] Filed: Jan. 29, 1992

[51] Int. Cl.[5] ..... A63B 55/04

[52] U.S. Cl. ..... 248/97; 248/99

[58] Field of Search ..... 248/95, 97, 99, 100, 248/101, 150, 153; 141/391; 220/404; 53/390

[56] References Cited

U.S. PATENT DOCUMENTS

| | | | |
|---|---|---|---|
| 3,638,888 | 2/1972 | Ross | 248/153 X |
| 3,773,286 | 11/1973 | Govoni | 248/150 X |
| 4,458,867 | 7/1984 | Malik | 248/99 X |
| 4,512,540 | 4/1985 | Stroh . | |
| 4,750,694 | 6/1988 | Bateman | 248/97 |
| 4,821,985 | 4/1989 | DeMatteis | 248/97 |
| 4,856,740 | 8/1989 | MacLeod | 248/99 X |
| 4,921,197 | 5/1990 | Benoit . | |

FOREIGN PATENT DOCUMENTS 745748 5/1933 France ..... 49/109

OTHER PUBLICATIONS

Mobil Grocery Sack Racks, Price List Effective Dec. 1, 1988.

Fast-Pak-Plus Grocery Sack System.

Mobil Fast-Pak Plus Marketote and Mini-Tote.

*Primary Examiner*—J. Franklin Foss

*Attorney, Agent, or Firm*—Alexander J. McKillop; Charles J. Speciale

[57] ABSTRACT

A collapsible holder for thermoplastic bags having support holes in the handles thereof has two arms pivotally mounted at the top of the holder. A platform is pivotally mounted at the bottom of the holder. In the bag loading position, the platform extends outwardly to support a bag being loaded. As the platform is moved to the collapsed position against the holder, a linkage moves the arms downwardly and inwardly so the holder extends a minimal distance from the vertical surface on which it is mounted.

12 Claims, 4 Drawing Sheets

COLLAPSIBLE HOLDER FOR THERMOPLASTIC BAGS

The present invention relates to a holder for a pack of thermoplastic bags having support holes in the handles thereof and more particularly to a holder which is collapsible to conserve space.

Groceries are packaged at check-out counters by the packer retrieving a bag from a stack, opening the bag, and loading the bag upright on the counter.

Recently, efforts have been made to overcome the tedious procedure described above by packaging items in plastic bags. However, these plastic bags are limp and, thus, create problems in both loading and carrying.

The plastic industry has attempted to overcome these deficiencies by providing handles on plastic bags adjacent to the mouth of the bag. This has helped to alleviate the carrying problem, but the loading operation is still a problem since flexible plastic bags are not rigid enough unsupported to allow for quick loading of items to be carried in them.

Elaborate devices have been used to open and support empty bags, such as blowers which fill the bags with air and vacuum systems which hold the walls of the bag apart and upright, but these systems can be expensive, require substantial redesign and modifications of check-out counters and are subject to mechanical breakdown in heavy use.

U.S. Pat. Nos. 4,676,378, Baxley et al. and 3,552,697, Pinto show thermoplastic bags having support holes in the handle thereof and a holder with arms extending through the holes in the handles. U.S. Pat. No. 3,747,298, Lieberman shows a bag holder with protruding arms extending through the bag handles and a platform for holding the bag while loading.

These bag holders are often used in areas where space is at a premium, such as convenience stores, department stores, meat and deli markets and so on. It is an object of the present invention to provide a bag holder which is collapsible to conserve space when the bag holder is not in use.

SUMMARY OF THE INVENTION

The bag holder of the present invention is collapsible against the vertical surface from which it hangs. The bag holder closes inwardly to a minimal thickness from the mounting surface. To use the holder, the platform is pulled outwardly and downwardly to form a flat work area. Hinged, spaced arms swing outwardly and upwardly to hold the handles of a bag pack which is suspended therefrom. When not in use, the platform is pushed upwardly and inwardly, which action causes the arms to fold downwardly and inwardly on the outward side of the folded bag holder.

The bag holder of the present invention provides considerable advantages in storage, handling, and shipping.

The foregoing and other objects, features and advantages of the invention will be better understood from the following, more detailed description and appended claims.

SHORT DESCRIPTION OF THE DRAWINGS

DESCRIPTION OF THE PREFERRED EMBODIMENT

Figure 3:
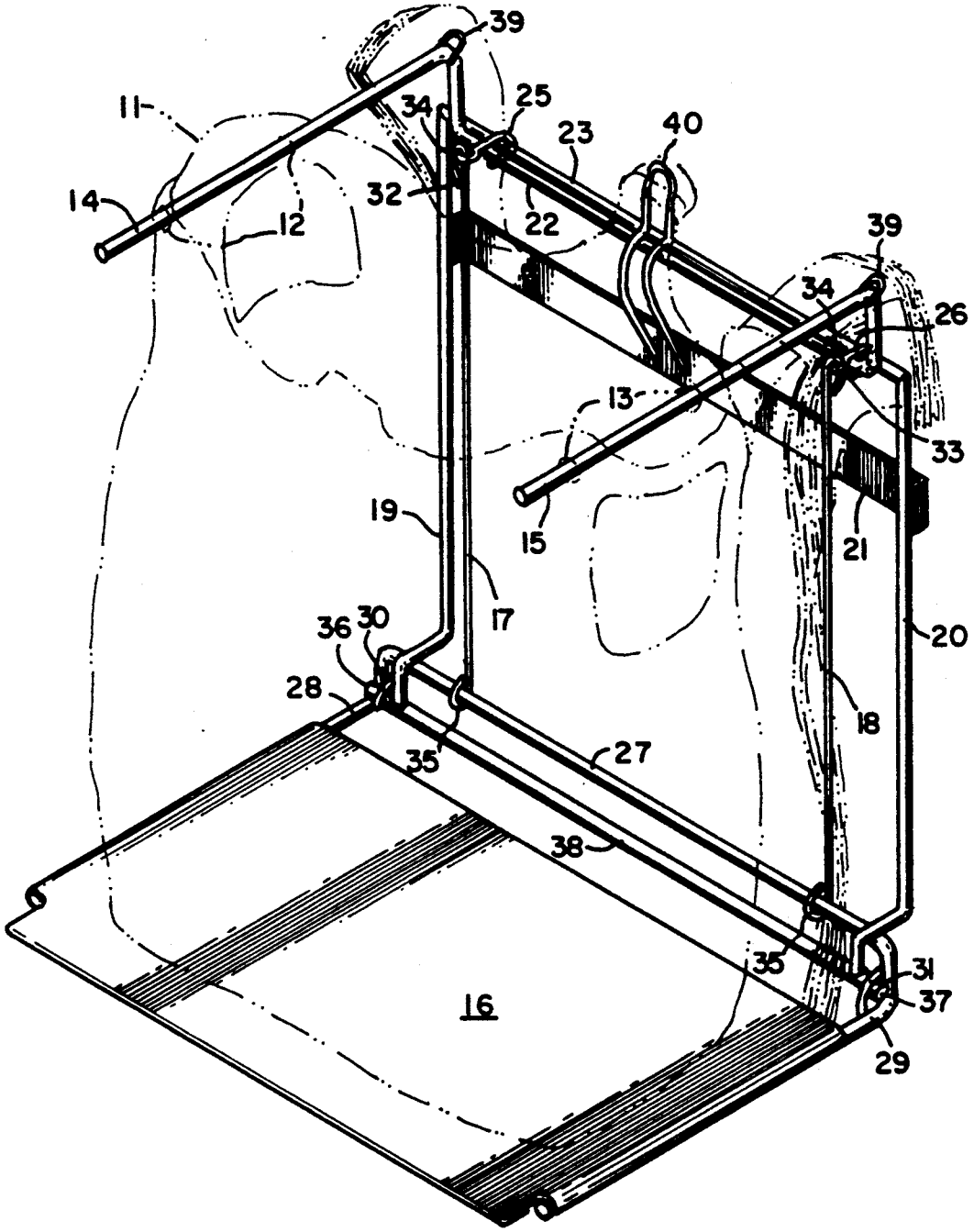
FIG. 3 is a perspective view showing the holder in the bag loading position with a pack of bags and one bag in the loading position.

The holder of the present invention is for a pack of thermoplastic bags such as the bag 11 shown in the loading position in FIG. 3. Each bag has support holes 12 and 13 in the handles of the bag.

Figure 1:
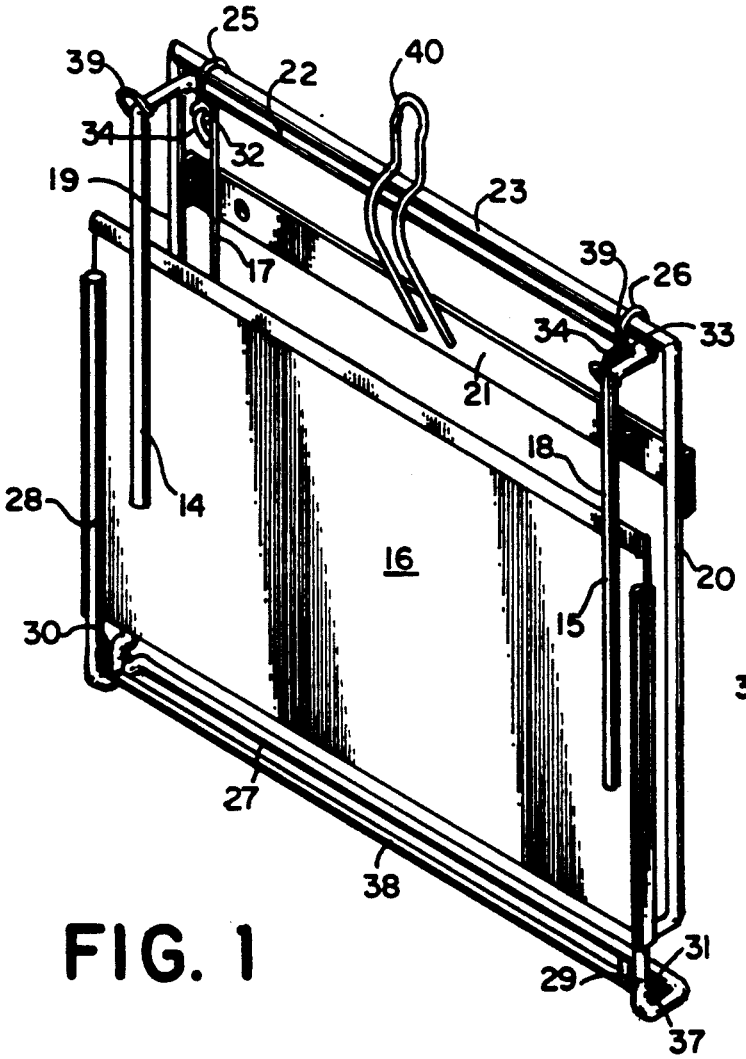
FIG. 1 is a perspective view of the holder of the present invention in the collapsed position.
Figure 2:
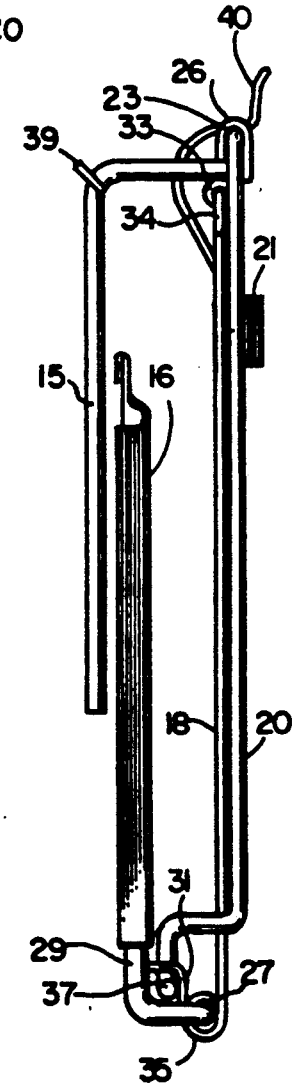
FIG. 2 is a side view of the holder in the collapsed position.
Figure 5:
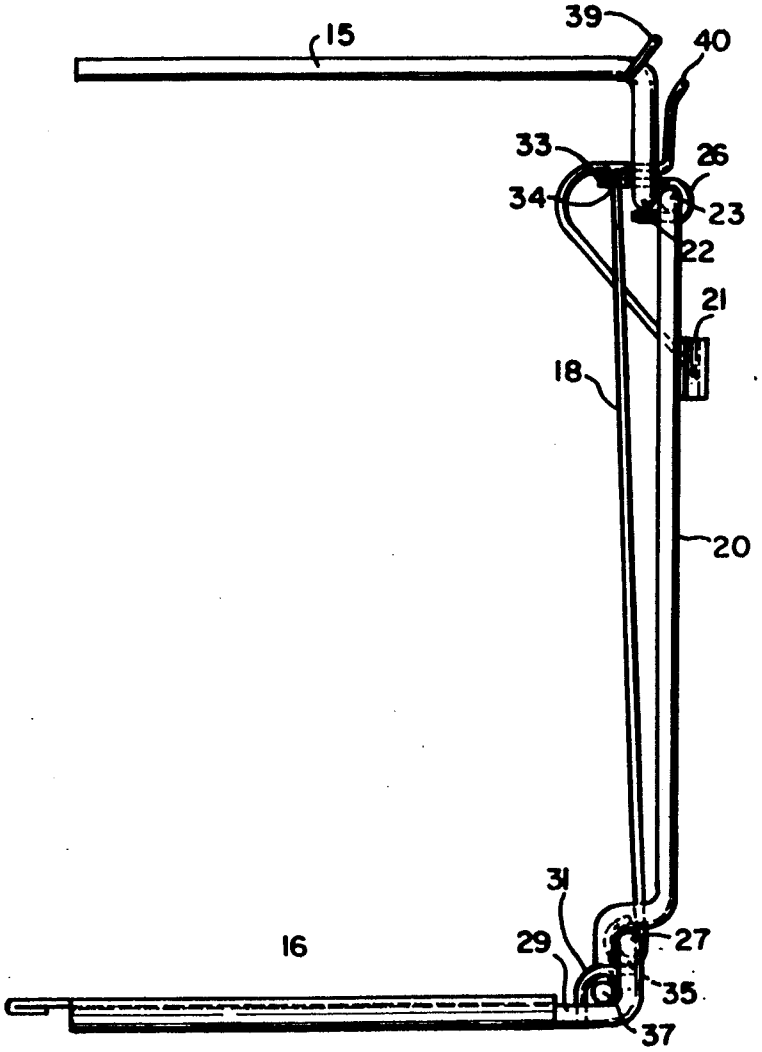
FIG. 5 is a side view of the holder in the open position.
Figure 4:
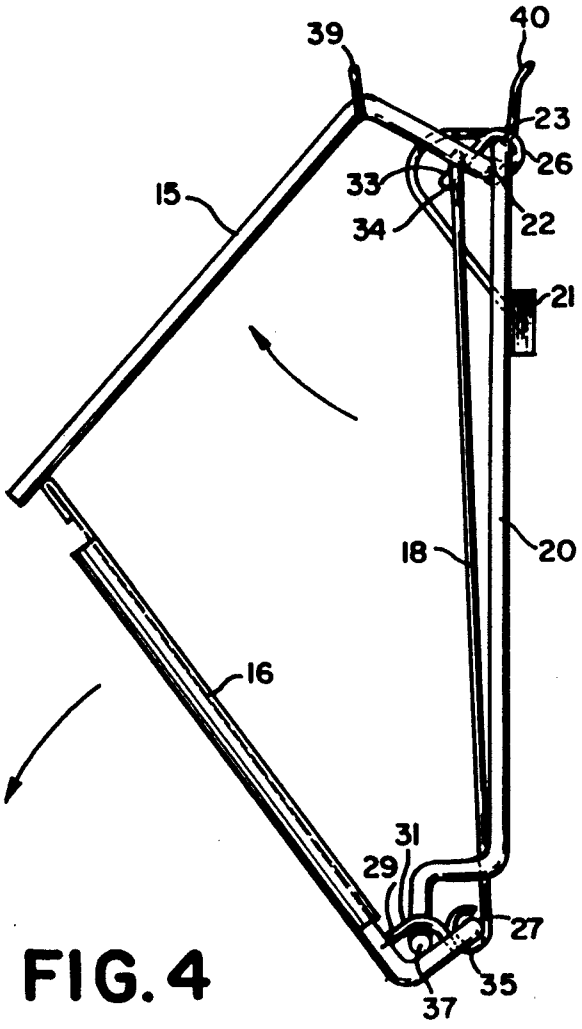
FIG. 4 is a side view with the holder partially opened.
Figure 7:
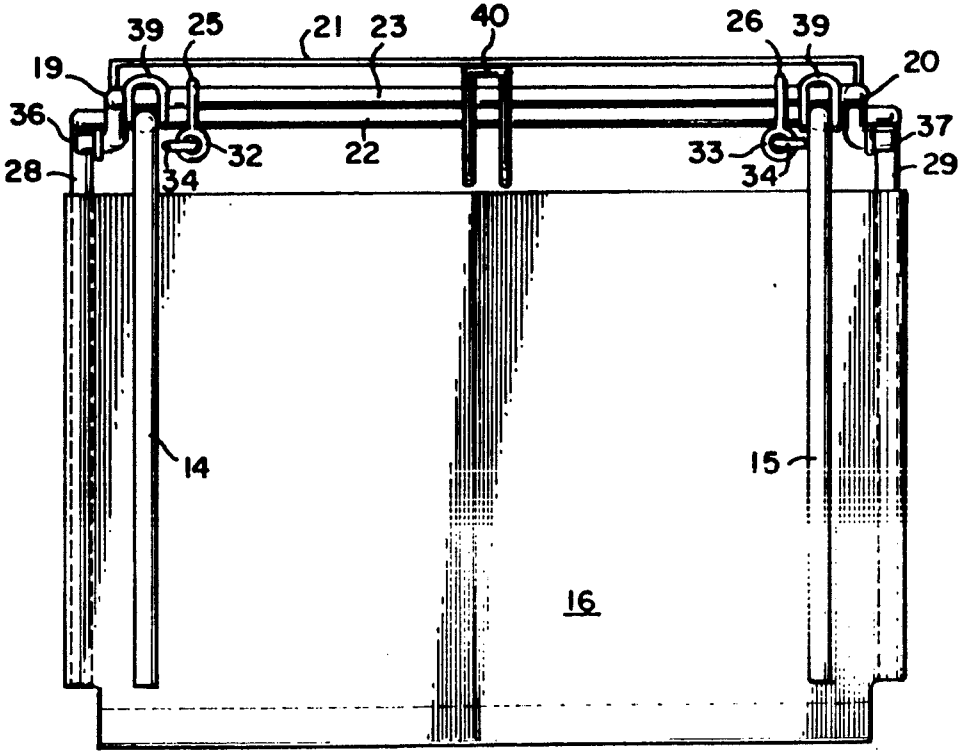
FIG. 7 is a top view of the holder.
Figure 6:
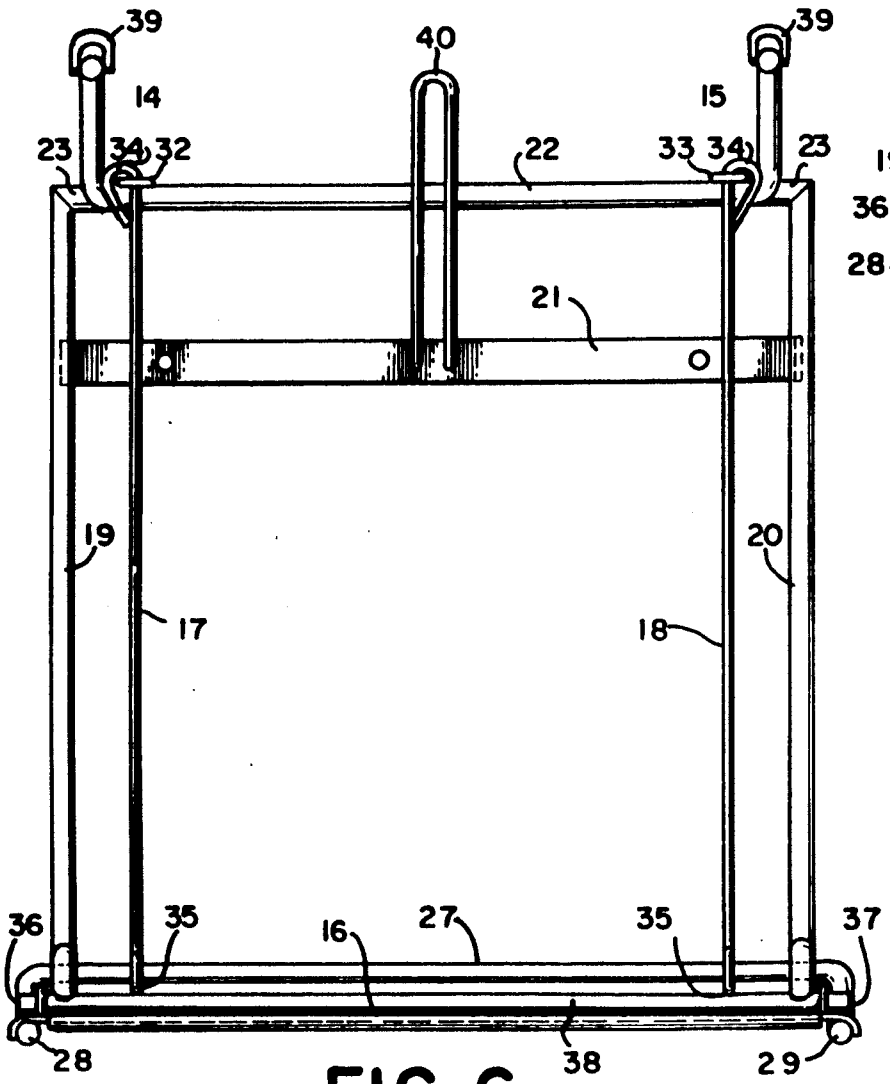
FIG. 6 is a front view of the holder.

Two arms 14 and 15 are pivotally mounted at the top of the holder. The arms extend downwardly when the holder is in the collapsed position of FIG. 2 and extend outwardly when the holder is in the bag loading position as shown in FIG. 5. The arms extend through the holes in the handles of the bag.

A platform 16 is pivotally mounted at the bottom of the holder. The platform is flat against the holder in the collapsed position (FIG. 2) and extends outwardly to support one of the bags which is being loaded when the holder is in the bag loading position as shown in FIG. 5.

A linkage comprises two linkage bars 17 and 18 which interconnect the platform 16 and the arms 14 and 15 so that when the platform is moved outwardly and downwardly, the linkage moves the arms upwardly and outwardly. In the collapsed position, the arms and the platform are disposed against the vertical surface. In the bag loading position, the arms and the platform extend outwardly from the vertical surface.

The holder includes two vertical fixed members 19 and 20 and a top fixed horizontal bar 23 which is an extension of vertical fixed members 19 and 20. The horizontal member 21 extending between members 19 and 20 is secured, as by screws, to a vertical surface.

An upper moveable horizontal bar 22 extends between and is an extension of, the arms 14 and 15. The upper moveable horizontal bar 22 is rotatable between the collapsed position and the bag loading position. U-shaped members 25 and 26 are each fastened to the upper moveable horizontal bar 22. Each U-shaped member encircles the top fixed horizontal bar 23 so that the U-shaped members 25 and 26, the upper moveable horizontal bar 22, and the arms 14 and 15 rotate about the top fixed horizontal bar 23.

A bottom moveable horizontal bar 27 has two platform bars 28 and 29 extending obliquely therefrom. The platform 16 is mounted on the platform bars 28 and 29. Quarter circle members 30 and 31 encapture the fixed jog members 36 and 37 which are extensions of the fixed horizontal member 38. The platform 16 rotates about the fixed jog members 36 and 37.

The linkage bars 17 and 18 are each connected at the top thereof through eyelets 32 and 33 to the U-shaped members 25 and 26. Linkage bars 17 and 18 encircle the bottom moveable horizontal bar 27 thereby providing a connection to the bottom moveable horizontal bar. This connects each linkage bar at a moving pivot 34 to the top moveable horizontal bar and at a moving pivot 35 to the bottom moveable horizontal bar. The arms 14 and 15 rotate about top fixed pivot points 34 at the top fixed horizontal bar 23. The platform 16 rotates about bottom fixed pivot points at the fixed jog members 36 and 37 which are extensions of fixed horizontal for member 38. As extensions of horizontal bar 38, jog members 36 and 37 are prevented from moving toward each other and becoming dislodged from quarter circle members 30 and 31.

Wicket 40 holds the bag pack on the rack.

The arms, linkage, and fixed members are constructed of rigid steel bars which can be fabricated into the desired shape.

While a particular embodiment of the invention has been shown and described, various modifications may be made without departing from the true spirit and scope of the invention.

What is claimed is:

1. A collapsible holder for thermoplastic bags having support holes in the handles thereof comprising:

two arms pivotally mounted at the top of said holder, said arms extending downwardly when said holder is in the collapsed position and extending outwardly when said holder is in the bag loading position, said arms being adapted to extend through the holes in the handles of said bags;

a platform pivotally mounted at the bottom of said holder, said platform being flat against said holder in the collapsed position, said platform extending outwardly to support one of said bags which is being loaded when said holder is in the bag loading position; and two linkage bars each being connected at the top thereof to said two arms and at the bottom thereof to said platform so that when said platform is moved outwardly said arms move upwardly and outwardly.

2. The holder recited in claim 1 further comprising:

two vertical fixed members and a fixed horizontal member extending between said vertical fixed member, said fixed horizontal member being adapted to be secured to a vertical surface so that said arms and said platform extend from said vertical surface in the bag loading position and are disposed against said vertical surface in the collapsed position.

3. The holder recited in claim 2 further comprising:

an upper moveable horizontal bar which is an extension of and extends between said two arms, said upper moveable horizontal bar being rotatable between said collapsed position and said bag loading position.

4. The holder recited in claim 3 further comprising a top fixed horizontal bar which is a extension of and extends between said vertical fixed members.

5. The holder recited in claim 4 further comprising:

two U-shaped members, each being fastened to said upper moveable horizontal bar, each U-shaped member encircling said top fixed bar so that said U-shaped members, said upper moveable horizontal bar and said arms rotate about said top fixed horizontal bar.

6. The holder recited in claim 5 further comprising:

a bottom moveable horizontal bar;

two platform bars extending obliquely from said bottom moveable horizontal bar, said platform being mounted on said platform bars.

7. The holder recited in claim 6 further comprising:

first and second jog members which are extensions of said vertical fixed members;

a quarter circle member at the oblique junction of each platform bar and each jog member, each quarter circle member encapturing one of said jog members so that said platform rotates about said jog members.

8. The holder recited in claim 7 wherein said: two linkage bars are each connected at the top thereof to said U-shaped members and are each connected at the bottom thereof to said bottom moveable horizontal bar.

9. The holder recited in claim 8 wherein each linkage bar is connected at a moving pivot to said top and said bottom moveable horizontal bars and wherein said arms rotate about a fixed pivot at said top fixed horizontal bar and said platform rotates about a fixed pivot at said jog members.

10. The holder recited in claim 9 wherein said jog members are an extension of said fixed horizontal bar which insures that said jog members do not dislodge from sid quarter circle members.

11. The holder recited in claim 1 wherein said arms and said linkage are constructed of rigid steel bars.

12. A collapsible holder for thermoplastic bags having support holes in the handles thereof comprising:

two arms pivotally mounted at the top of said holder, said arms extending downwardly when said holder is in the collapsed position and extending outwardly when said holder is in the bag loading position, said arms being adapted to extend through the holes in the handles of said bags;

a platform pivotally mounted at the bottom of said holder, said platform being flat against said holder in the collapsed position, said platform extending outwardly to support one of said bags which is being loaded when said holder is in the bag loading position;

a linkage interconnecting said platform and said arms so that when said platform is moved outwardly said arms move upwardly and outwardly;

two vertical fixed members and a fixed horizontal member extending between said vertical fixed member, said fixed horizontal member being adapted to be secured to a vertical surface so that said arms and said platform extend from said vertical surface in the bag loading position and are disposed against said vertical surface in the collapsed position; and an upper moveable horizontal bar which is an extension of and extends between said two arms, said upper moveable horizontal bar being rotatable between said collapsed position and said bag loading position; and a top fixed horizontal bar which is an extension of and extends between said vertical fixed members.

* * * * *